US005862944A

United States Patent [19]

Scherr

[11] Patent Number: 5,862,944

[45] Date of Patent: Jan. 26, 1999

[54] DISPENSER FOR PLASTIC BAGS

[75] Inventor: Donald Scherr, West End, N.J.

[73] Assignee: U.S. Plastics, Ltd., Long Branch, N.J.

[21] Appl. No.: 805,880

[22] Filed: Mar. 3, 1997

Related U.S. Application Data

[63] Continuation-in-part of Ser. No. 540,163, Oct. 6, 1995, Pat. No. 5,657,900.

[51] Int. Cl.[6] ..... B65H 1/00

[52] U.S. Cl. ..... 221/63; 206/554

[58] Field of Search ..... 221/63, 33, 45; 206/225, 554, 494; 383/37

[56] References Cited

U.S. PATENT DOCUMENTS 4,216,863 8/1980 Seymour-Smith ..... 206/554

*Primary Examiner*—Kenneth Noland

*Attorney, Agent, or Firm*—Marvin Feldman

[57] ABSTRACT

A dispenser is formed of a flexible plastic pouch which has a removable flap providing an opening adjacent the bottom of the pouch, and a transversely disposed thermoplastic band adjacent the flap opening for reinforcing the pouch at the opening. A plurality of stacked reclosable ended, opened, separate plastic bags are disposed in a folded stack within the pouch. The folded plastic bags abut the reinforcing band adjacent the bottom of the pouch. A portion of one outermost plastic bag reclosable end is disposed in the pouch opening, so that the user by the thumb and then the forefinger pulls the one plastic bag end portion causing the one plastic bag to slide over the adjacent plastic bag and through the opening without tearing the pouch. After removal of the one bag, the next adjacent bag is then similarly positioned for removal. The removed plastic bag is immediately ready for filling. The dispenser of the present invention avoids undue manipulation to remove and eliminates the need to open the bag. Suitable uses include dispensing cigar bags and deli bags.

13 Claims, 5 Drawing Sheets

FIG. 1
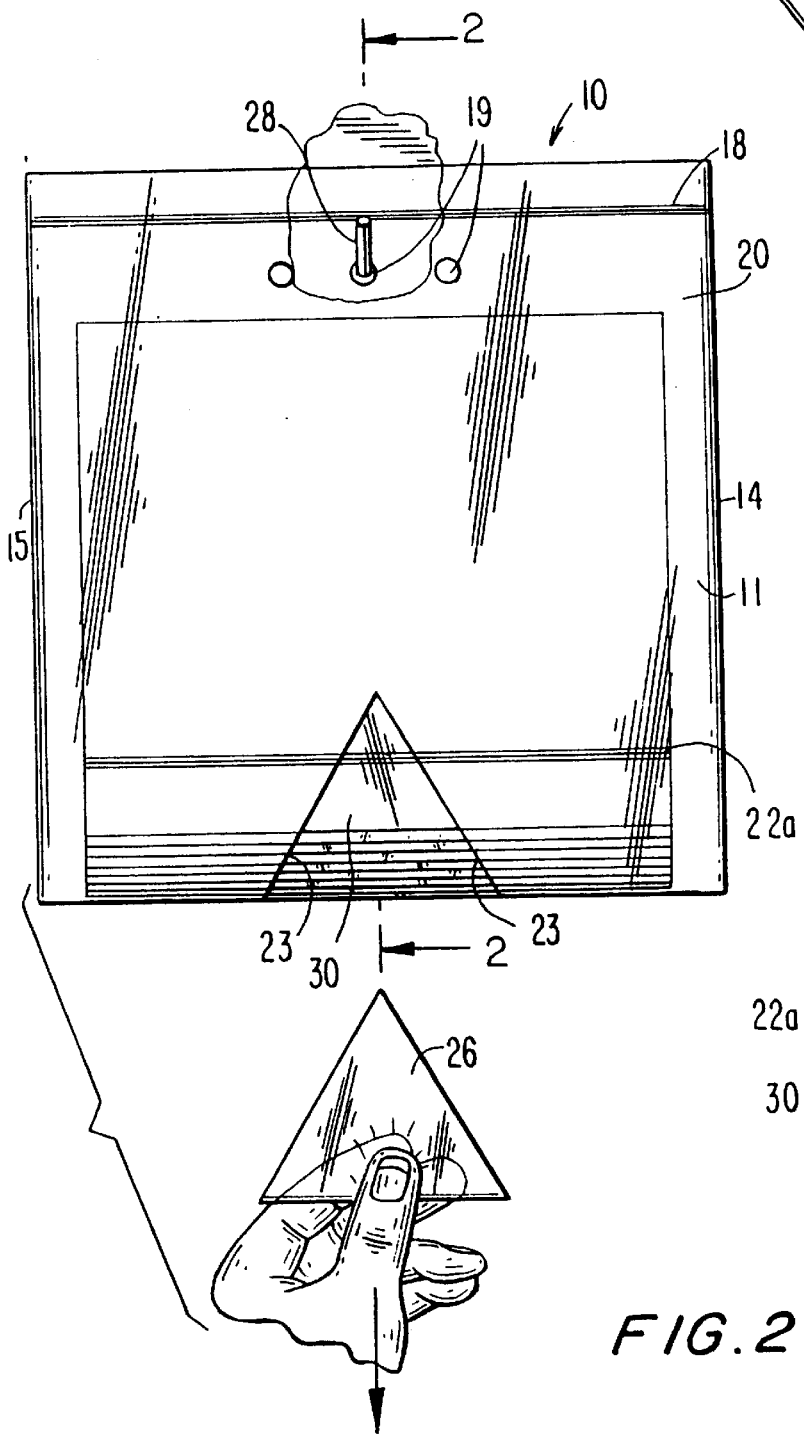
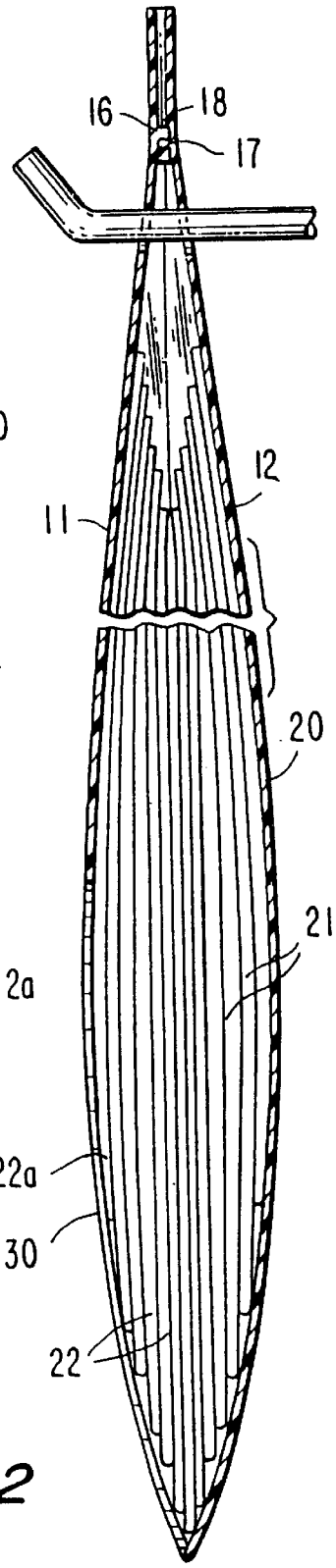
FIG. 2

FIG. 5
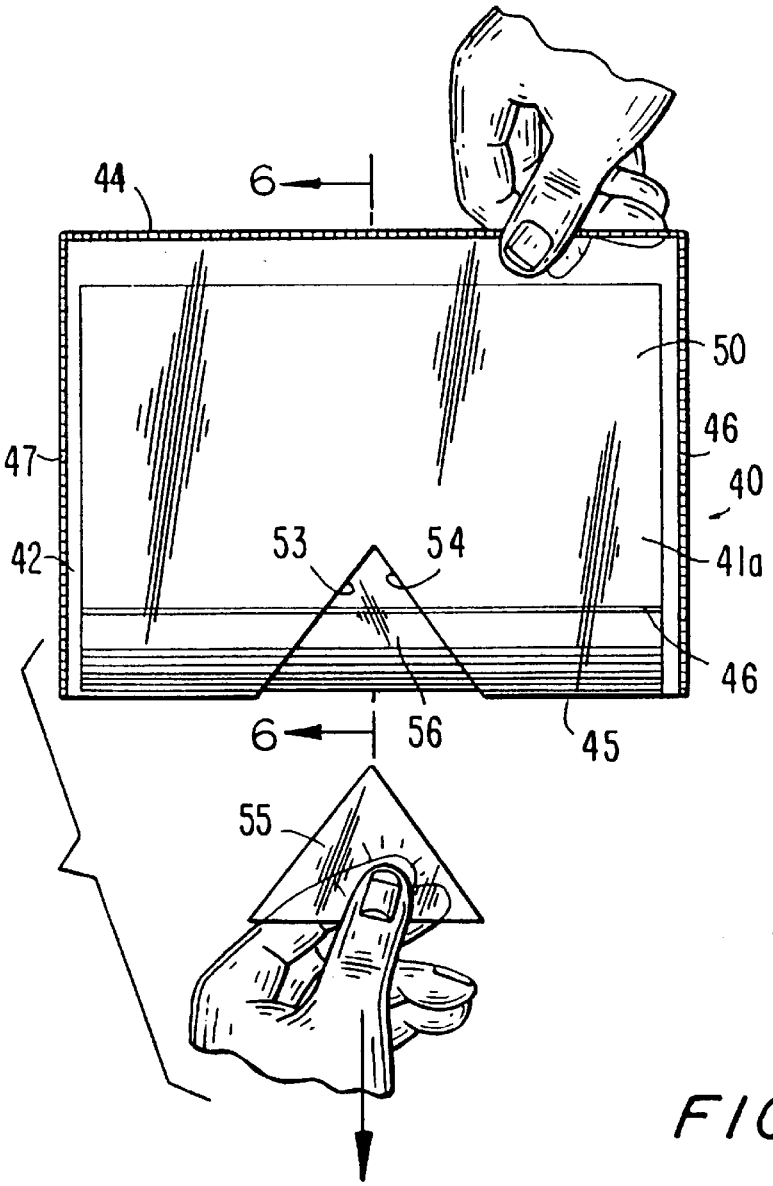
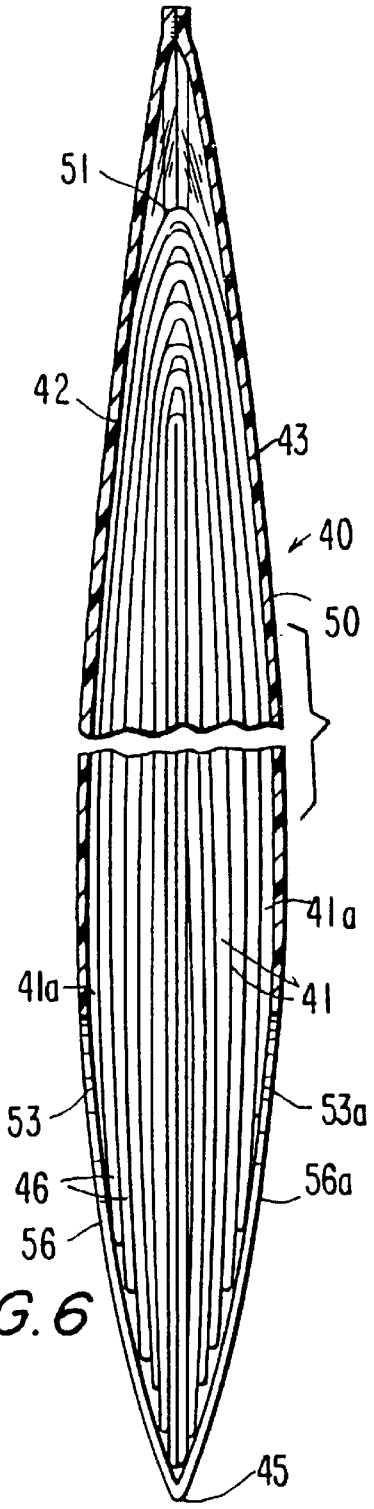
FIG. 6

DISPENSER FOR PLASTIC BAGS

RELATED APPLICATION

This application is a continuation-in-part of application Ser. No. 08/540,163, filed Oct. 6, 1995 now U.S. Pat. No. 5,657,900.

BACKGROUND OF THE INVENTION

1. Field of the Invention

This invention relates to a dispenser for plastic bags.

2. Discussion of the Prior Art

In the art directed to dispensers for plastic bags, such constructions were generally constructed of rigid box-like containers wherein the plastic bags were separably interconnected within the box. Such dispensers are disclosed in U.S. Pat. Nos. 4,712,684 to Boeckman, 4,805,800 to Nocek et al and 5,109,978 to Cawley. One attempt to make the plastic bags more readily removable from a box is disclosed in U.S. Pat. No. 4,512,276 to Herrington. In Herrington the plastic bags had to first be individually folded on parallel fold lines formed in each bag and then assembled and stacked within the box. In another rigid walled construction bag dispenser, as disclosed in U.S. Pat. No. 5,267,423 to Ngugen, separated stacked bags were mounted on a roller bar.

Another prior art approach was where there was no container or dispenser, and instead the plastic bags were detachably attached on a header with the user having to pull and separate the bag from the header usually at a perforated line, and open the bag during or after removal. Such prior art constructions are disclosed in U.S. Pat. Nos. 3,221,927 to Lowry, 4,290,467 to Schmidt, 4,846,586 to Bruno, 5,255,883 to Greenfield et al, 5,309,698 to Huseman and 5,419,437 to Huseman.

It was known in the plastic bag art to provide pin holes in the bag walls to assist in separation of the bags removed from the stacks, as disclosed in U.S. Pat. No. 5,188,235 to Pierce et al. Gussetted bags were provided with reinforcing bonds to prevent stress tears as disclosed in U.S. Pat. No. 4,812,055 to Prader.

One attempt to provide a dispenser for plastic bags is disclosed in U.S. Pat. No. 4,216,863 to Seymour-Smith. The Seymour-Smith construction required that the bags be in a flat unfolded unstacked disposition.

These prior art dispenser constructions were not suitable for readily dispensing stacked bags without damage to a thin flexible dispenser. The art desired a readily manufactured and assembled low cost flexible construction bag dispenser which could store and readily dispense a folded stack of pre-opened bags without damage to the flexible dispenser. The present invention achieves these prior art goals.

SUMMARY OF THE INVENTION

A dispenser is formed of flexible plastic panels or sheets joined or thermoplastically bonded at the edges to form a flexible plastic pouch having a removable flap adjacent the bottom of the pouch. A plurality of separate reclosable plastic bags are in stacked disposition and sliding engagement within the pouch. The reclosable ends of the bags are open. The bags are in a folded stacked arrangement, and the pouch flexes outwardly to accommodate the stacked plastic bags. In use, the bags are disposed adjacent the bottom of the pouch and abut a transversely disposed reinforcing thermoplastic bond. The bond is preferably a strip or band that extends transversely across the flap to the side edges of the pouch. A pair of thermoplastically bonded portions form pin holes dispersed adjacent the flap for additional reinforcement to that provided by the transverse band. The removable flap is preferably triangularly shaped and formed by perforations in one or both of the panels. When the flap is removed at the perforations, a triangularly shaped opening is provided, for access to a portion of the outermost bag.

To remove a bag, a user, using the thumb and then the forefinger of one hand, pulls the outermost plastic bag disposed in the opening, downwardly so that the outermost plastic bag slides over the adjacent plastic bag of the folded stacked bags, which outermost bag folds inwardly on itself in contactingly engaging the pouch edges forming the triangular opening. After removal of the outermost bag, the immediately adjacent bag is then disposed in the opening. The removed opened bag is immediately ready for filling and closure.

DESCRIPTION OF THE DRAWINGS

FIG. 1 is a front elevational assembly view of one embodiment of the dispenser of the present invention;

FIG. 2 is an enlarged partial fragmentary sectional view taken along line 2—2 of FIG. 1;

FIG. 5 is a front elevational assembly view of a second embodiment of the present invention;

FIG. 6 is an enlarged partial fragmentary view taken along line 6—6 of FIG. 5;

DESCRIPTION OF THE PREFERRED EMBODIMENTS

Figure 3:
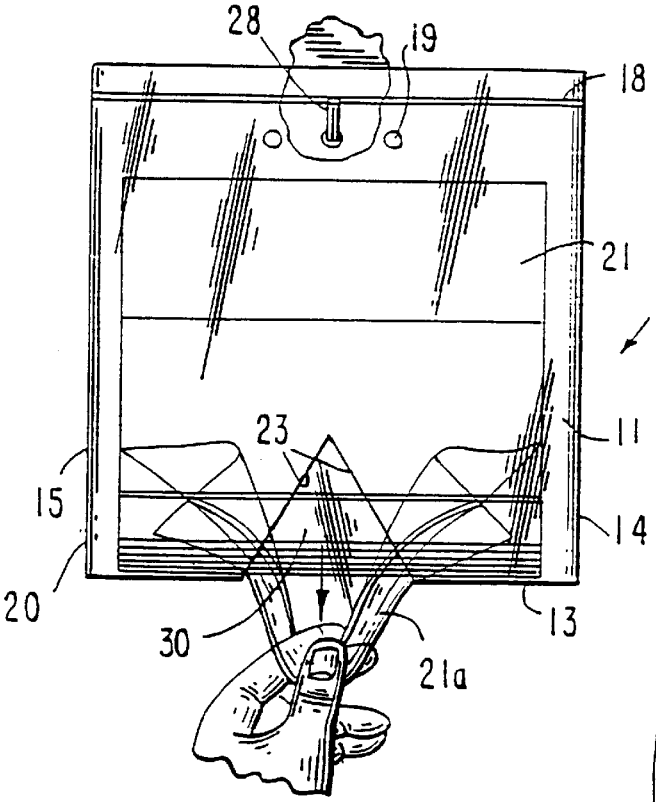
FIG. 3 is a reduced elevational view of the embodiment of FIG. 1, but showing the removal of a bag from the dispenser.

Referring to FIGS. 1–4, there is shown the dispenser 10 of one embodiment of the present invention. Dispenser 10 is formed of a flexible thermoplastic front panel or sheet 11 and a flexible thermoplastic back panel or sheet 12, which panels 11 and 12 are thermoplastically bonded at bottom edge 13 and side edges 14 and 15. A set of interlocking profiles 16 and 17 are formed on the respective top inside portions of panels 11 and 12 to provide a reclosable end seal or zipper 18, as is well known in the art. With zipper 18 closed, a closed flexible pouch 20 is provided for reasons hereinafter appearing. A plurality of three through holes 19 (typical) are formed in the panels 11 and 12, which holes 19 are disposed downwardly from zipper 18. The holes 19 permit mounting the pouch 20 on a fixedly mounted hook 28. The closed zipper 18 portion provides reinforcement at the top end of pouch 20 to prevent tearing of the pouch adjacent the holes 19 in using the dispenser.

A plurality of stacked bags 21 are disposed in pouch 20 between panels 11 and 12. The panels are flexed apart by the stack of bags, as best shown in FIG. 2. The plastic bags 21 are formed with reclosable zippers 22, as is well known in the art. The bags 21 are disposed so that the zippers 22 are adjacent the bottom edge 13 of the pouch 20. The bags 21 are in the open condition within pouch 20. That is, zippers 22 are unlocked with the bags enclosed within the pouch.

Front panel 11 is formed with a series of perforations 23 which form a triangular flap or piece 26. The zippers 22 or zippered portions of bags 21 are disposed behind flap 26. Pouch 20 is manufactured as a reclosable thermoplastic bag which is then provided with perforations 23 formed in panel 11, and holes 19 formed in panels 11 and 12, by plastic sheet cutting means well known in the art. Bags 21 are reclosable plastic bags of conventional construction. Bags 21 are unclosed when stacked within pouch 20, and pouch 20 is then sealed by and at zipper 18. The bags 21, while opened are nonetheless maintained in a contaminant-free environment within closed pouch 20, until the removal of flap 26 and use of dispenser 10.

Figure 4:
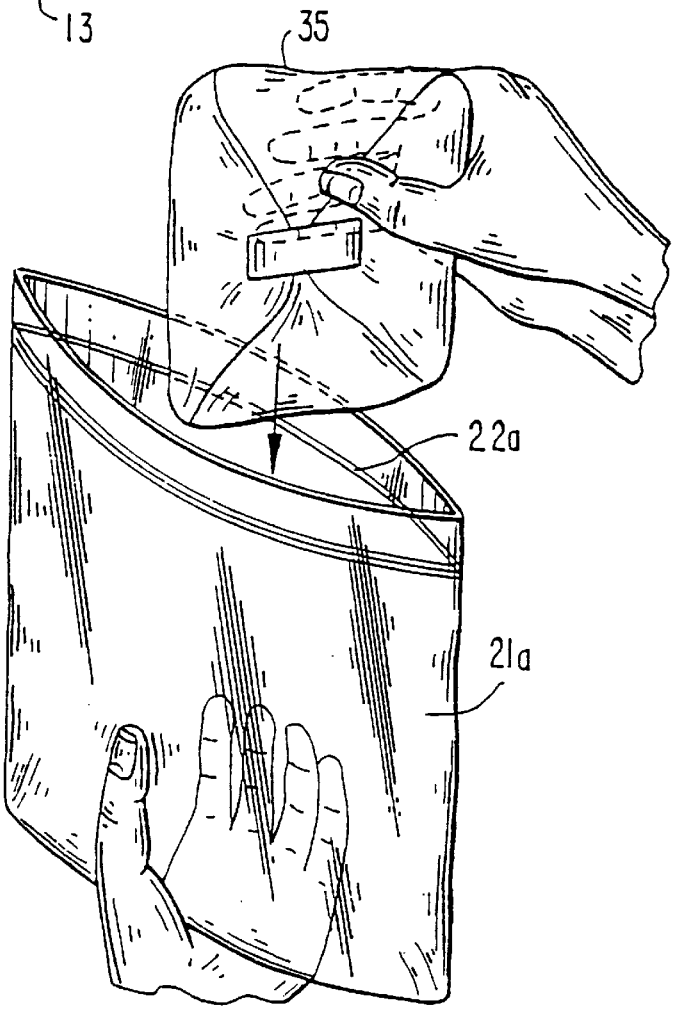
FIG. 4 is a perspective view showing the user filling the removed bag.
Figures 7, 10:
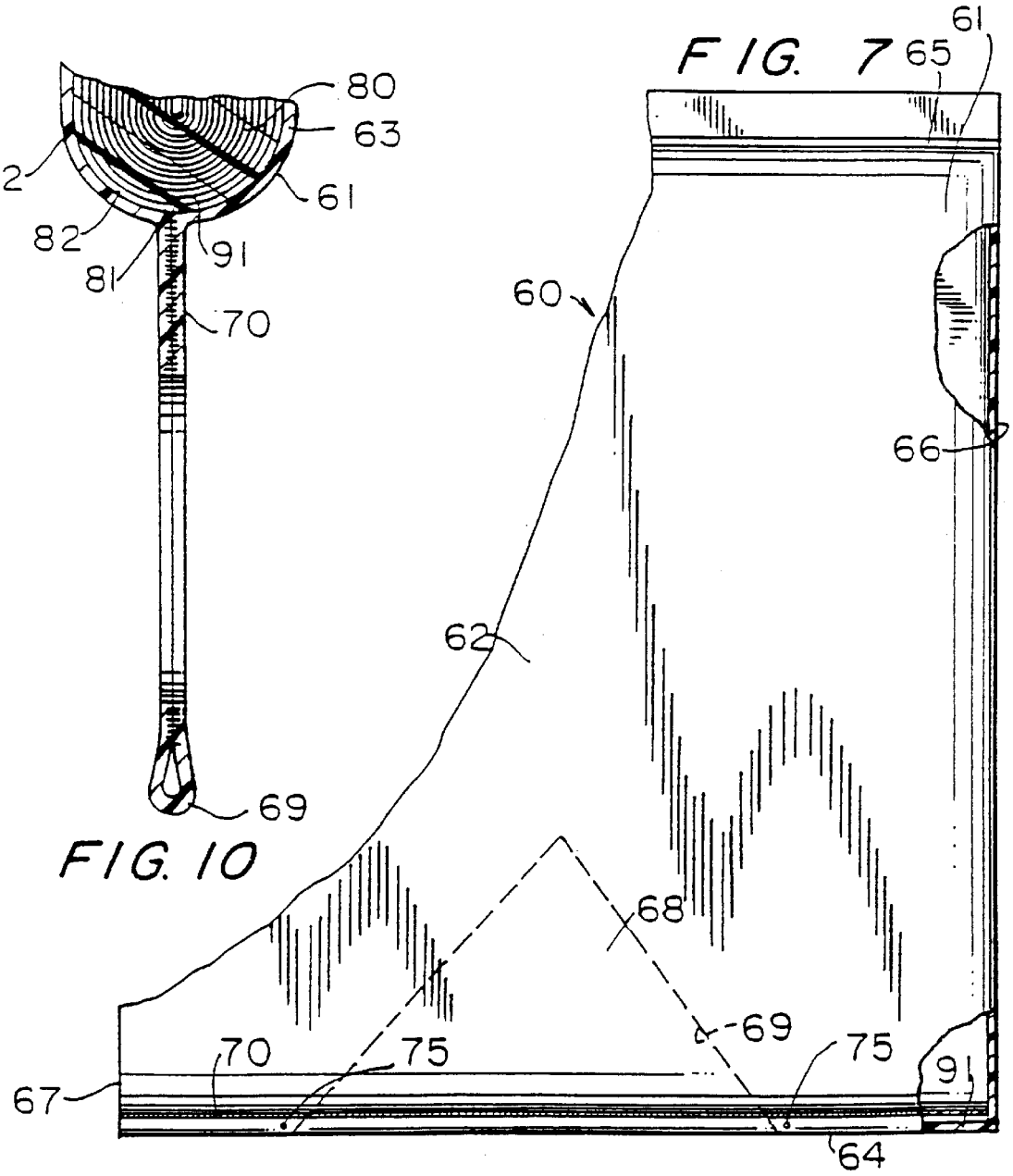
FIG. 7 is a front plan partial fragmentary view of a third embodiment of the present invention.
FIG. 10 is a greatly enlarged sectional view taken along line 10—10 of FIG. 8.
Figure 8:
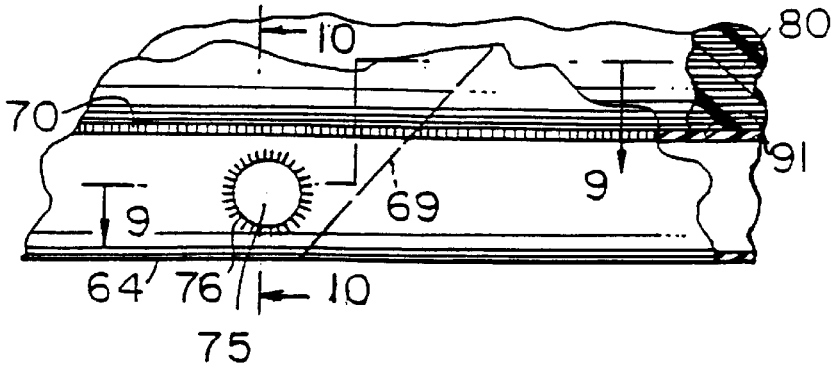
FIG. 8 is an enlarged front fragmentary view of the bottom edge portion of the embodiment of FIG. 7.
Figure 9:
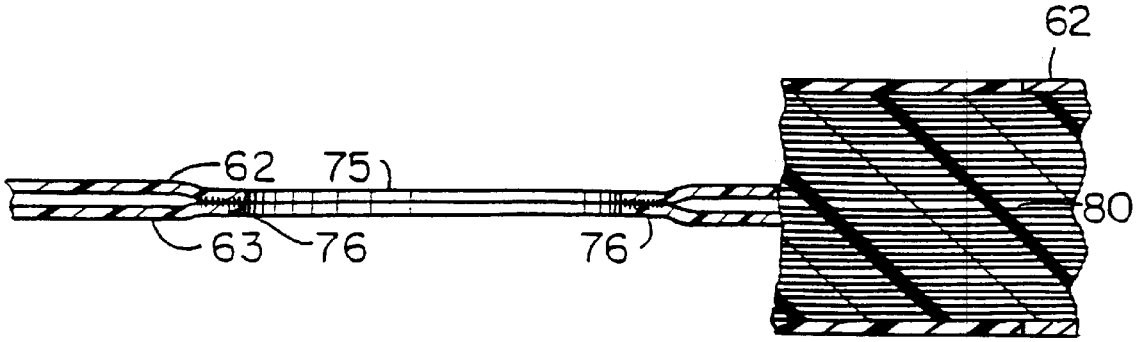
FIG. 9 is a greatly enlarged sectional view taken along line 9—9 of FIG. 8.

To use dispenser 10, the user first mounts pouch 20 on hook 28 by hole 19. The user then breaks perforations 23 and removes flap 26 (FIG. 1). With the removal of flap 26, the opened reclosable end 22*a* of the top or outermost bag 21*a* is disposed with the opening 30 formed by the removal of flap 26. The user using the thumb and then the forefinger pulls end 22*a* downwardly causing bag 21*a* to slide free of the immediately adjacent stacked bag. In removing bag 21*a*, bag 21*a* is caused to fold inwardly on itself by edges 29 forming opening 30, as best shown in FIG. 3. The removed bag 21*a* is immediately available to be filled. Referring specifically to FIG. 4, there is shown the filling of the preopened removed bag 21*a* with a freshly wrapped deli meat package 35.

It is to be noted that in use the stack of bags 21, may be prefolded or self-fold through gravity and with bag removal. The folded stack is however accommodated by the flexed apart panels 11 and 12. When folded, the bag stack assists in insuring that the reclosable end of the outermost bag is disposed within opening 30 for ready removal. That is, the folded stack of bags is a preferred embodiment, as further discussed in connection with the embodiment of FIGS. 5 and 6.

Referring to FIGS. 5 and 6, there is shown a second embodiment of the present invention, dispenser 40. Dispenser 40 is designed primarily for the storage and removal of small reclosable bags 41, while dispenser 10 is better suited for large reclosable bags 21.

Dispenser 40 is formed of a front flexible thermoplastic sheet or panel 42 and a back flexible thermoplastic sheet or panel 43 which panels are sealed or thermoplastically bonded at top edge 44, bottom edge 45 and side edges 46 and 47 to form an enclosed flexible pouch 50. Bags 41 are stacked, and the stack of bags folded as at 51. Bags 41 are reclosable plastic bags having zippers or zipper closures 46 of conventional construction. With the stack of bags folded, the zipper closures 46 are disposed adjacent the bottom edge 45 of pouch 50.

A set of perforations 53 and 54 are formed on front panel 42, with a like contiguous set of perforations formed on back panel 43. (See FIG. 6 showing like back panel perforation 53*a*). In this manner of construction, a folded double triangular or quadrilateral flap or piece 55 is formed when the perforations are broken. With flap 55 removed, respective front and back triangular openings 56 and 56*a* are formed.

To use dispenser 40, the user holds top bonded edge 44 with the fingers of one hand to retain pouch 50, and with the other hand separates flap 55 from the pouch, as best shown in FIG. 5. The user then, while continuing to retain the pouch with one hand as shown in FIG. 5, using the thumb and forefinger of the other hand removes the outermost bag 41*a* from pouch 50 in a manner similar to that described in connection with the embodiment of FIGS. 1–4. Bag 41*a* slides over the immediately adjacent bag and is infolded upon itself (not shown) and is removed from pouch 50 through opening 56. The removed bag is ready to be filled. That is, bags 41 may be sealed within pouch 50 with bags 41 in the opened condition. The bags remain clean within the pouch until flap 55 is removed. While the flap is shown as being formed on the front panel in connection with the embodiment of FIGS. 1–4, a contiguous similar flap may be formed on the back panel, as shown in the preferred embodiment of FIGS. 5 and 6.

Referring to FIGS. 7–10 there is shown a third embodiment of the present invention, bag dispenser 60. Dispenser 60 includes pouch 61 formed of front panel 62, back panel 63, bottom fold 64 connecting panels 62 and 63, top sealed end portion 65, and oppositely disposed sealed side edges 66 and 67. Front panel 62 is formed with a triangular flap 68 formed by perforations 69 similar to that shown and described in the embodiments of FIGS. 1–6. In this latter embodiment, a thermoplastic heat seal 70 bonds panel 62 and 63 and extends transversely across flap 68 to panel edges 66 and 67. Seal 70 is spacedly disposed from but adjacent to bottom fold 64 for purposes hereinafter appearing. Two reinforcing heat seal pin holes 75 are formed in panels 62 and 63 providing annular reinforcing thermoplastic heat seals 76 formed around each pin hole 75.

A plurality of stacked folded thermoplastic bags 80 are disposed within pouch 61. Bags 80 are folded as at 81 so that the outermost bag 82 has its fold 81 abut reinforcing heat seal 70 as best shown at 91 in FIG. 10. The openable ends (not shown in FIGS. 7–10) of bags 80 are disposed adjacent dispenser top end portion 65. Seal 70 provides a secure bottom support rest 91 for bags 80, and importantly prevents stress tearing in front panel 61, when flap 68 is removed and the outermost bag 82 is removed from the dispenser. That is the removal of the folded stacked outermost bag places stress on the perforated edges 69 of the triangular opening there causing tearing of panel 62. Seal 70, and optionally in combination with pin hole seals 76, prevent stress tearing of panel 62 at the triangular opening.

The embodiment of FIGS. 7–10 is formed from a flexible thermoplastic sheet, which sheet is folded as at 64 and sealed at edges 66 and 67. Seal 70, pin hole seals 76, and perforations 69 are then formed in pouch 61. The bags 80 are folded and placed in pouch 61 with folds 81 abutting seal 70 at 91. The top end portion 65 is then heat sealed to complete the dispenser construction. The aforesaid construction is by thermoplastic bag making means well know in the art.

In a preferred embodiment, the pouch plastic sheet thickness is greater than the sheet thickness of the individual plastic bags. These relative sheet thicknesses provide the desired combination of flexibility and structural support. In a further preferred embodiment, the pouch sheet thickness is about 3.5 to 4.5 mils and preferably about 4.0 mils, and the plastic bag sheet thickness is about 1.5 to 3.0 mils.

The flap is preferably triangularly shaped with one side or edge of the triangular flap disposed adjacent and parallel to the bottom edge of the pouch. The length of then bottom edge of the flap opening extends about ⅓ of the length of the bottom edge of the pouch. The triangular shape is approximately equilateral. It is to be understood however that the dispenser may be sold with the flap removed, but it is most desirable to have the flap in place until just prior to use to insure that the deli bags are sealed within the pouch and remain clean and contaminant-free until use. The band width of seal 70 is preferably ¼ to ½ inch.

While the means for mounting the pouch is described as holes in the thermoplastic panels, other mounting means are within the contemplation of the invention. One such other mounting means, by way of example, is a reinforced thermobonded band disposed above or adjacent holes to support the pouch.

As is apparent from the foregoing description, there is provided by this invention a dispenser which permits a user with greasy fingers to readily remove a bag, such as a deli bag, with only minimal manipulation and force, and yet the removed bag is immediately available to be filled and closed, which dispenser is readily manufactured by inexpensive means of low cost thermoplastic sheeting, and which low cost dispenser, after depletion of the bags, is readily disposed of.

While the invention has been described in conjunction with preferred specific embodiments thereof, it will be understood that this description is intended to illustrate and not limit the scope of the invention, which is defined by the following claims.

What is claimed is:

1. A dispenser for plastic bags comprising; front panel means and back panel means and first means for joining the panel means to form pouch means, one said panel means being formed with opening means, said front and back panel means comprise flexible construction, second means for joining said front and back panel means, said second means for joining the panel means being disposed adjacent said opening means, for reinforcing the one said panel means adjacent the opening means and a plurality of separate plastic bags in folded stacked disposition within said pouch means between said front and back panel means, with a portion of one plastic bag disposed at said opening means, whereby a user pulls the one plastic bag portion through the opening means to remove the one plastic bag from the pouch means without tearing the panel means.

2. The dispenser of claim 1, said opening means comprising flap means formed by perforations in the front panel means, wherein with separation of the flap means at the perforations an opening is provided in the front panel means for removal of the plastic bags.

3. The dispenser of claim 2, said second means for joining the panel means being transversely disposed on the front panel means.

4. The dispenser of claim 2, said second means for joining the panel means being transversely disposed on the flap means.

5. The dispenser of claim 1, said pouch means having a top, bottom and opposed sides, said pouch means comprising plastic sheet means comprising a fold forming said bottom and said front and back panel means, said front and back panel means having respective edges and said first means joining the respective edges to form said pouch means.

6. The dispenser of claim 5, said second means for joining the panel means being spacedly disposed from the fold.

7. The dispenser of claim 6, each said plastic bag comprising a reclosable end portion, wherein the plastic bags are stacked so that the reclosable end portions are disposed adjacent the top, and said plastic bags being separate from and in sliding engagement with each other.

8. The dispenser of claim 6, said sheet means comprising thermoplastic construction and said second means for joining the panel means comprising a thermoplastic heat seal band.

9. The dispenser of claim 6, third means for joining said front and back panel means, said third means being formed with two spacedly disposed holes adjacent to the opening means.

10. The dispenser of claim 9, said holes bags being disposed between said band and said fold.

11. A dispenser for plastic bags comprising; first flexible panel means, second flexible panel means, and means for bonding said first and second panel means to form flexible pouch means, one said panel means being formed with opening means, a plurality of plastic bags, said plastic bags being stacked and in sliding disposition inside said pouch means, second means for bonding the panel means to form a bond disposed adjacent the opening means, one said plastic bag being disposed adjacent the bond, said opening means comprising flap means formed by perforations in the front panel means, wherein with separation of the flap means at the perforations an opening is provided in the front panel means for removal of the plastic bags, said pouch means having a top and a bottom, said second means for bonding the panel means comprising band means spacedly disposed from and adjacent to said bottom, whereby a user pulls the one plastic bag through the opening means in the one said panel means so the one plastic bag slides free of an adjacent stacked plastic bag to remove the one plastic bag from the pouch means without tearing the panel means, and with removal of the one plastic bag the adjacent plastic bag is then disposed at the opening means.

12. The dispenser of claim 11, said band means being transversely disposed on said front panel means and said band means.

13. The dispenser of claim 11, said band means having a width of from about ¼ to ½ inch.

* * * * *